US010163395B2

(12) United States Patent
Nakamura

(10) Patent No.: US 10,163,395 B2
(45) Date of Patent: Dec. 25, 2018

(54) DISPLAY DEVICE

(71) Applicant: Japan Display Inc., Tokyo (JP)

(72) Inventor: Norio Nakamura, Tokyo (JP)

(73) Assignee: Japan Display Inc., Tokyo (JP)

( * ) Notice: Subject to any disclaimer, the term of this patent is extended or adjusted under 35 U.S.C. 154(b) by 0 days.

(21) Appl. No.: 15/385,145

(22) Filed: Dec. 20, 2016

(65) Prior Publication Data

US 2017/0249901 A1 Aug. 31, 2017

(30) Foreign Application Priority Data

Feb. 25, 2016 (JP) ..... 2016-034360

(51) Int. Cl.

| | |
|---|---|
| ***G09G 3/3258*** | (2016.01) |
| ***G09G 3/3233*** | (2016.01) |
| ***G09G 3/3266*** | (2016.01) |
| ***G09G 3/3291*** | (2016.01) |

(52) U.S. Cl.

CPC ..... *G09G 3/3258* (2013.01); *G09G 3/3233* (2013.01); *G09G 3/3266* (2013.01); *G09G 3/3291* (2013.01); *G09G 2300/0426* (2013.01); *G09G 2300/0819* (2013.01); *G09G 2300/0852* (2013.01); *G09G 2300/0866* (2013.01); *G09G 2310/08* (2013.01); *G09G 2320/0233* (2013.01); *G09G 2320/0247* (2013.01); *G09G 2330/021* (2013.01); *G09G 2330/023* (2013.01)

(58) Field of Classification Search

CPC .. G09G 3/3258; G09G 3/3266; G09G 3/3233; G09G 2320/0233; G09G 2320/0247; G09G 2330/023; G09G 2310/08; G09G 2300/0426

See application file for complete search history.

(56) References Cited

U.S. PATENT DOCUMENTS

| | | | | |
|---|---|---|---|---|
| 6,522,319 | B1 * | 2/2003 | Yamazaki | G09G 3/20 345/103 |
| 2002/0135312 | A1 * | 9/2002 | Koyama | G09G 3/3225 315/169.3 |
| 2011/0090200 | A1 * | 4/2011 | Choi | G09G 3/3233 345/211 |

(Continued)

FOREIGN PATENT DOCUMENTS

| | | | |
|---|---|---|---|
| JP | 2009-229553 | A | 10/2009 |
| WO | 2013/088483 | A1 | 6/2013 |

OTHER PUBLICATIONS

Korean Office Action dated Dec. 1, 2017, for the corresponding Korean application No. 10-2016-0175314, with partial English Translation.

*Primary Examiner* — Md Saiful A Siddiqui
(74) *Attorney, Agent, or Firm* — Typha IP LLC

(57) ABSTRACT

A method for driving a display device in an embodiment according to the present invention, the method including step of displaying an image in accordance with a first video signal in a first frame period, and displaying the image in accordance with the first video signal after the first frame in a second frame period. The image in the first frame period is displayed after an end of a non-display period, the non-display period is shorter than the first frame period, and the non-display period is inserted after writing of the video signal in the first frame period and before display of the image.

4 Claims, 6 Drawing Sheets

(56) References Cited

U.S. PATENT DOCUMENTS

| | | | | |
|---|---|---|---|---|
| 2012/0206467 | A1* | 8/2012 | Shih | G09G 3/344<br>345/545 |
| 2013/0155124 | A1* | 6/2013 | Tsuge | G09G 5/10<br>345/690 |
| 2014/0253525 | A1* | 9/2014 | Munechika | G09G 3/3611<br>345/204 |
| 2015/0001504 | A1* | 1/2015 | Kim | H01L 27/32<br>257/40 |
| 2017/0140700 | A1* | 5/2017 | Yamamoto | G09G 3/30 |

* cited by examiner

DISPLAY DEVICE

CROSS REFERENCE TO RELATED APPLICATIONS

This application is based upon and claims the benefit of priority from the prior Japanese Patent Application No. 2016-034360, filed on Feb. 25, 2016, the entire contents of which are incorporated herein by reference.

FIELD

An embodiment of the present invention is related to a display device and a method of driving a display device.

BACKGROUND

Liquid crystal display devices are attracting attention as a flat panel display which is light weight and has low power consumption. Among these, since active matrix type liquid crystal display devices which are arranged with switching elements such as a transistor for each display pixel can obtain high definition display images with no crosstalk, they are being used for each type of display starting with a screen for mobile phones.

An example of writing a black signal in the latter half of a first frame period in an active matrix type liquid crystal display device is disclosed in Japanese Laid Open Patent Publication No. 2009-229553. By writing a black signal in this way, even in an active matrix type liquid crystal display device, it is possible to obtain video with no sense of blurring the same as impulse type display device such as a CRT.

SUMMARY

A method for driving a display device in an embodiment according to the present invention, the method including steps of displaying an image in accordance with a first video signal in a first frame period, and displaying the image in accordance with the first video signal after the first frame in a second frame period. The image in the first frame period is displayed after an end of a non-display period, the non-display period is shorter than the first frame period, and the non-display period is inserted after writing of the video signal in the first frame period and before display of the image.

A method for driving a display device in an embodiment according to the present invention, the method including steps of displaying an image in accordance with a first video signal in a first frame period, and displaying the image in accordance with the first video signal after the first frame in a second frame period. During the first frame period, fixing a control potential of the transistor to an initial potential, setting a voltage based on the threshold voltage of the transistor, setting a gate-source voltage based on the threshold voltage of the transistor, writing a voltage based on a video signal to the gate of the transistor, displaying the image in accordance with the gate-source voltage. Inserting a non-display period shorter than the first frame period after the writing a voltage of a video signal in the first frame period, and starting displaying the image after the end of the non-display period.

A display device in an embodiment according to the present invention includes a display region arranged with a plurality of pixels including a transistor supplying a drive current to a display element, a video display mode including a first frame period displaying a first video according to a first video signal, and a second frame period displaying a second video according to a second video signal, and a still image display mode including a first frame period displaying a third video according to a third video signal, and a second frame period displaying the third video after the first frame period according to the third video signal. The still image display mode includes a non-display period shorter than the first frame period after arranged after the video signal writing period in the first frame period is completed and before display of the video, and display of the video is performed after the non-display period is completed.

A display device in an embodiment according to the present invention includes a display region arranged with a plurality of pixels including a transistor supplying a drive current to a display element, a video display mode including a first frame period displaying a first video according to a first video signal, and a second frame period displaying a second video according to a second video signal, and a still image display mode including a first frame period displaying a third video according to a third video signal, and a second frame period displaying the third video after the first frame period according to the third video signal. The first frame period includes at least an initialization period setting a control potential of a transistor to a predetermined potential in each pixel, an offset cancel period obtaining a potential difference conforming to a threshold of the transistor, a video signal writing period determining a gate-source voltage of the transistor according to the first video signal, a display period displaying video according to the gate-source voltage, and the still image display mode includes a non-display period shorter than the first frame after arranged after the video signal writing period in the first frame period is completed and before display of the video, and display of the video is performed after the non-display period is completed.

DESCRIPTION OF EMBODIMENTS

Figure 1:
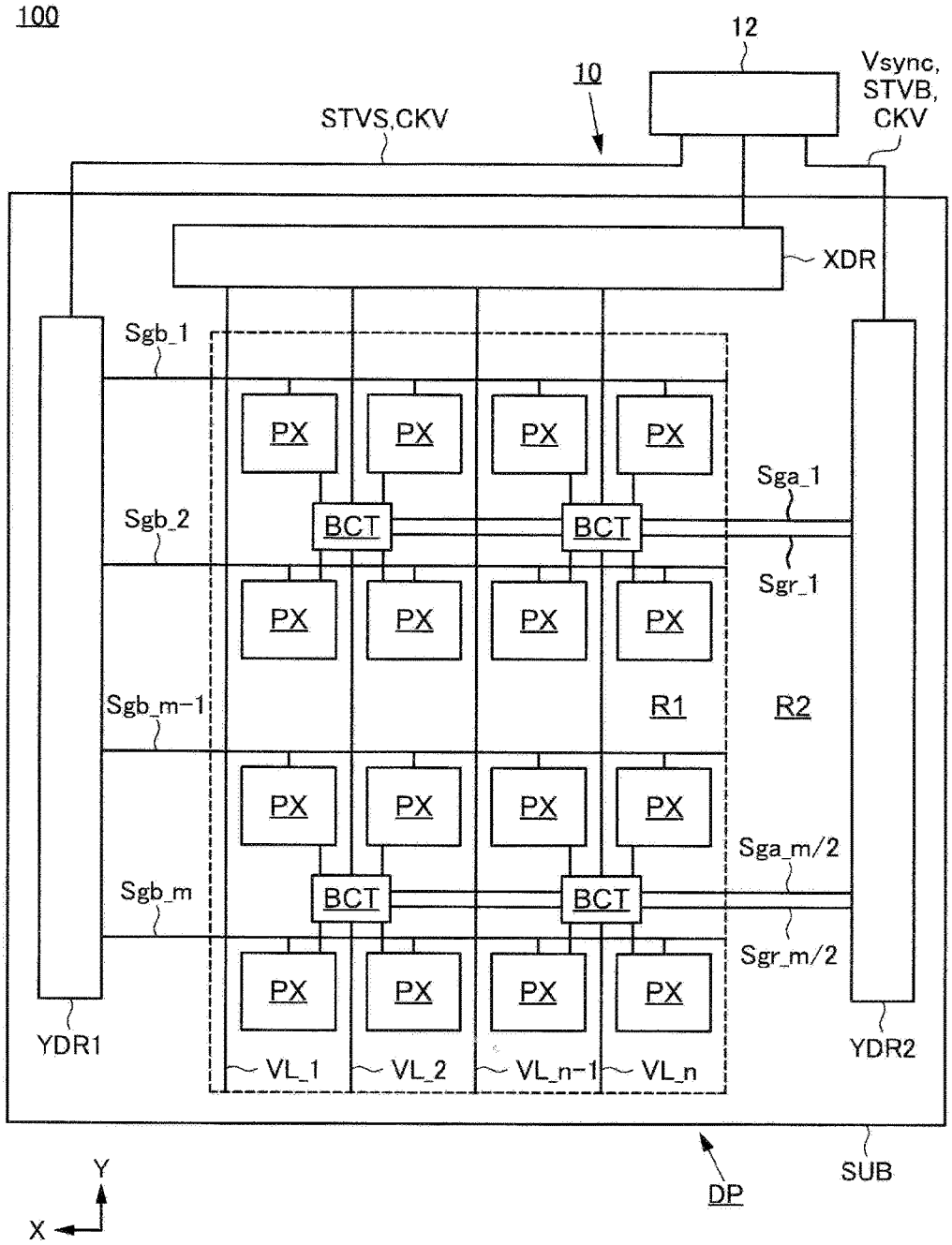
FIG. 1 is a schematic diagram showing a structure of a display device related to one embodiment of the present invention.

A driving method of a display device related to the present invention is explained in detail below while referring to the drawings. The driving method of a display device related to the present invention is not limited to the embodiments herein and it is possible to be realized by carrying out various modifications. In addition, the dimension ratios in the drawings are different from actual ratios for the purposes of explanation and structural parts may be omitted from the drawings.

In recent years, display devices realizing low power consumption by processing a display by reducing a frame rate are attracting attention. In this type of display device, in the case where the frame rate is reduced by half the normal rate for example, the input of a video signal to each pixel is thinned out by a ratio of once every two times. In this way, since the frequency of a video signal may be half the usual rate, low power consumption can be realized.

However, significant flickering occurs just by thinning out the input of a video signal. That is, a charge written to a storage capacitor in each pixel using a video signal at the start point of a frame period drops together with the passing of time due to leaks and the like. Therefore, even in a normal state where a frame rate is not reduced, although luminance at the end point of a frame period is slightly reduced compared to luminance at the start point of a frame period, when the frame rate is reduced by half for example, since a charge is charged to a storage capacitor within each pixel only once in two frame periods, luminance at the end point of the second frame period counting from after the charge is written to the storage capacitor drops even further compared to luminance at the end point of the first frame period. A problem occurs whereby a viewer experiences significant flickering due to this large change in luminance.

One embodiment of the present invention discloses a display device and a method of driving a display device which can achieve an improvement in image quality by preventing the occurrence of flickering in the case where a display is processed by reducing a frame rate.

Figure 2:
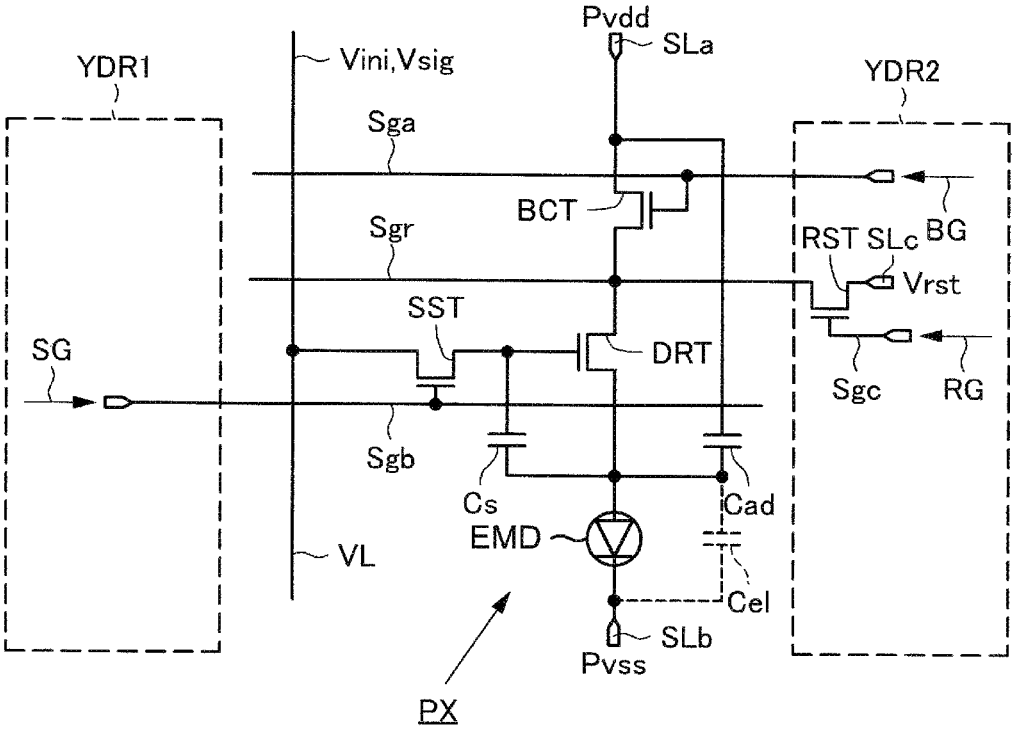
FIG. 2 is a diagram showing an internal structure of a pixel PX shown in FIG. 1.

FIG. 1 is a schematic diagram showing a structure of a display device 100 related to one embodiment of the present invention. In addition, FIG. 2 is a diagram showing an internal structure of a pixel PX shown in FIG. 1.

As is shown in FIG. 1, the display device 100 includes a display region R1 in which pixels PX are arranged in a row direction and column direction, a display panel DP including scanning line drive circuits YDR1, YDR2, and a signal line drive circuit XDR, and a controller 12 which controls the operation of the display panel DP.

In the present embodiment, an organic electroluminescence element (referred to herein as "organic EL element") is arranged in a pixel PX as a display element.

As is shown in FIG. 1, the display panel DP is formed arranged with an insulation substrate SUB including translucency such as a glass plate, m×n number of pixels PX arranged in a matrix shape above the display region R1 arranged in the insulation substrate SUB, a plurality (m/2) of first scanning lines Sga_1~Sga_m/2, a plurality (m) of second scanning lines Sgb_1~Sgb_m, a plurality (m/2) of reset wires Sgr_1~Sgr_m/2, of and a plurality (n) of video signal lines VL_1~VL_n. Furthermore, in the explanation below, in the case where it is not necessary to distinguish sequence numbers attached to each line, the line may be described with the sequence number omitted. In addition, the display panel DP is further arranged with a plurality (m/2) of third scanning lines Sgc corresponding to each of the plurality (m/2) of reset wires Sgr as is shown in FIG. 2.

M number of pixels PX are each arranged along a column direction Y and n number of pixels PX are arranged along a row direction X respectively. The first scanning lines Sga, second scanning lines Sgb and reset wires Sgr are each arranged as wires extending in an X direction. The reset wires Sgr are formed by a plurality of electrodes mutually and electrically connected with each other. The video signal lines VL are arranged as wires extending in a Y direction.

As is shown in FIG. 2, the display panel DP includes a high voltage power supply line SLa fixed to a high voltage Pvdd, and a low voltage power supply electrode SLb fixed to a low voltage Pvss. The high voltage power supply line SLa is connected to a high voltage power supply not shown in the diagram, and the low voltage power supply electrode SLb is connected to a low voltage supply (reference voltage power supply) not shown in the diagram.

The display panel DP is also arranged with scanning line drive circuits YDR1, YDR2 and a signal line drive circuit XDR. The scanning line drive circuit YDR1 is a circuit for driving the plurality of first scanning lines Sga and plurality of third scanning lines Sgc for each row of a pixel PX in sequence, the scanning line drive circuit YDR2 is a circuit for driving the plurality of second scanning lines Sgb for each row of a pixel PX, and the signal line drive circuit XDR is a circuit for driving a plurality of video signal lines VL. The scanning line drive circuits YDR1, YDR2 and signal line drive circuit XDR are integrally formed above a non-display region R2 positioned in a periphery of the display region R1 of the insulation substrate SUB, and form the controller 12 and a drive section 10.

As is shown in FIG. 2, each pixel PX is formed including an organic EL element EMD and a pixel circuit which supplies a drive current to the organic EL element EMD. Furthermore, it addition to an organic EL element, it is also possible to use various types of light emitting element in each pixel PX.

A pixel PX is arranged with a circuit which controls light emitted by the organic EL element EMD according to a video signal comprised from a voltage signal. As is shown in FIG. 2, the pixel PX includes a first switching element SST, a drive transistor DRT, a storage capacitor Cs, an auxiliary capacitor Cad and a capacitor section Cel. The storage capacitor Cs and auxiliary capacitor Cad are capacitors. The auxiliary capacitor Cad is an element arranged for adjusting the amount of light emitting current and depending on the circumstances is not always necessary. The capacitor section Cel is a capacitor (parasitic capacitor of the organic EL element EMD) of the organic EL element EMD itself. The organic EL element EMD also functions as a capacitor.

In addition, each pixel PX is arranged with a second switching element BCT. As is shown in FIG. 1, the second switching element BCT may be shared between a plurality of pixels PX which are adjacent in a column direction. In the present embodiment, an example is shown in which one second switching element BCT is shared between four pixels PX which are adjacent in a row direction and column direction. In addition, as is shown in FIG. 2, a plurality of third switching elements RST is arranged in the scanning line drive circuit YDR2. A third switching element RST and a reset wire Sgr are connected one for one.

Here, the first switching element SST, drive transistor DRT, second switching element BCT and third switching element RST are first conductive type elements formed by N channel type transistors for example. A transistor in this case may be a thin film transistor formed with a channel in amorphous silicon, polysilicon or an oxide semiconductor. For example, each drive transistor and each switching element included in the display device 100 related to the present embodiment may be formed using a thin film transistor having a top-gate structure using polysilicon in a semiconductor layer, and are mutually formed in the same process and the same layer structure.

The first switching element SST, drive transistor DRT, second switching element BCT and third switching element RST each include a first terminal, second terminal and a control terminal respectively. In the present embodiment, the first terminal is given as a source electrode, the second terminal is given as a drain electrode and the control terminal is given as a gate electrode in a drive transistor DRT.

In a pixel circuit of a pixel PX, a drive transistor DRT and a second switching element BCT are connected in series with an organic EL element EMD between a high voltage power supply line SLa and low voltage power supply electrode SLb. The high voltage power supply line SLa (high voltage Pvdd) is set at a voltage of 10V for example, and the low voltage power supply electrode SLb (low voltage Pvss) is set at a voltage of 1.5V for example.

The second terminal of the second switching element BCT is connected to a high voltage power supply line SLa, the first terminal is connected to a drain electrode of the drive transistor DRT, and the control terminal is connected to a first scanning line Sga. In this way, the second switching element BCT is controlled so as to be either ON (conducting state) or OFF (non-conducting state) by a control signal from the first scanning line Sga. The second switching element BCT plays the role of controlling the light emitting time/non-light emitting time of an organic EL element EMD by this ON/OFF control. Furthermore, a control signal BG is a signal generated for each first scanning signal line Sga by the scanning line drive circuit YDR2.

The drain electrode of the drive transistor DRT is connected to a source electrode and reset wire Sgr of the second switching element BCT, and the source electrode is connected to one electrode (anode) of an organic EL element EMD. The other electrode (cathode) of the organic EL element EMD is connected to a low voltage power supply electrode SLb. The drive transistor DRT plays the role of outputting a drive current having a current amount according to a video signal Vsig to an organic EL element EMD.

The first terminal of the first switching element SST is connected to a video signal line VL, the second terminal is connected to a gate electrode of the drive transistor DT, and the control electrode is connected to a second scanning line Sgb which functions as a gate wire for signal writing control. The first switching element SST is controlled to be either ON (conducting state) or OFF (non-conducting state) by a control signal SG supplied from the second scanning line Sgb. The first switching element SST plays the role of controlling the connection state of a pixel circuit and video signal line VL in response to a control signal SG by this ON/OFF control, and importing a video sign Vsig from a corresponding video signal line VL to a pixel circuit. Furthermore, a control signal SG is a signal generated for each first scanning line Sga by the scanning line drive circuit YDR1.

The third switching element RST is arranged in the scanning line drive circuit YDR2 for every two rows. The third switching element RST is connected between a drain electrode and reset electrode (not shown in the diagram) of the drive transistor DRT. A first terminal of the third switching element RST is connected to a reset power supply line SLc connected to a reset power supply, the second terminal is connected to a reset wire Sgr, and the control terminal is connected to a third scanning line Sgc which functions as gate wire for reset control. The voltage of a reset power supply line SLc is fixed to a reset voltage Vrst which is a constant voltage passing though the reset power supply. A specific value of the reset voltage Vrst is −2V for example.

The third switching element RST is switched to a conducting state (ON) or non-conducting state (OFF) between a reset power supply line SLc and reset wire Sgr according to a control signal RG supplied through a third scanning line Sgc. Furthermore, a control signal RG is a signal generated for each third scanning line Sgc by the scanning line drive circuit YDR2. By switching the third switching element RST to an ON state, the voltage of a source electrode of the drive transistor DRT is initialized.

The controller 12 shown in FIG. 1 is formed above a printed circuit substrate (not shown in the diagram) arranged in an exterior section of the display panel DP, and includes a function for controlling the scanning line drive circuits YDR1, YDR2 and signal line drive circuit XDR. The controller 12 is configured to receive digital video signals and synchronization signals supplied from the exterior. The controller 12 is configured to generate a vertical scanning control signal which controls vertical scanning timing, and a horizontal scanning control signal which controls horizontal scanning timing based on a received synchronization signal. In addition, the generated vertical scanning control signal and horizontal scanning control signal are supplied to the scanning line drive circuits YDR1, YDR2 and the signal line drive circuit XDR, and a digital video signal and initialization signal are also supplied to the signal line drive circuit XDR in synchronization with horizontal and vertical scanning timing. Furthermore, a start signal STVS and clock signal CKV are included in a vertical scanning control signal and horizontal scanning control signal supplied to the scanning line drive circuit YDR1, and a synchronization signal Vsync, start signal STVB and clock signal CKV are included in a vertical scanning control signal and horizontal scanning control signal supplied to the scanning line drive circuit YDR2.

A signal line drive circuit XDR is configured to convert video signals obtained in sequence to an analog format during each horizontal scanning period by control of a horizontal scanning control signal, and supply a video signal Vsig according to gradation to a plurality of video signal lines VL in parallel. In addition, the signal line drive circuit XDR is configured to supply an initialization signal Vini to a video signal line VL. A video signal Vsig and initialization signal Vini are each supplied to a plurality of video signal lines VL respectively at a timing synchronized with a clock signal CKV. A specific value of an initialization signal Vini is 2V for example.

The scanning line drive circuit YDR1 includes a shift register (not shown in the diagram) and is configured to generate a control signal corresponding to each row in sequence by transferring a start signal STVS supplied from the controller 12 to the next stage in sequence. A generated control signal SG is supplied to each pixel PX in each corresponding row via an output buffer not shown in the diagram.

The scanning line drive circuit YDR2 also includes a shift register (not shown in the diagram) and is configured to generate control signals BG, RG corresponding to each row in sequence by transferring a synchronization signal Vsync and start signal STVS supplied from the controller 12 to the next stage in sequence. The generated control signal BG is supplied to each pixel PX in each corresponding row via an output buffer not shown in the diagram. On the other hand, the generated control signal RG is supplied to a gate electrode of a corresponding third switching element RST. In this way, the third switching element is turned to an ON state at a timing activated by the control signal RG, and a set voltage Vrst is supplied to a reset wire Sgr.

Next, a driving method of the display device 100 formed as described above is explained. After a normal driving method is first explained below while referring to FIG. 5 and FIG. 6, a driving method according to the present embodiment is explained while referring to FIG. 3 and FIG. 4.

Figure 5:
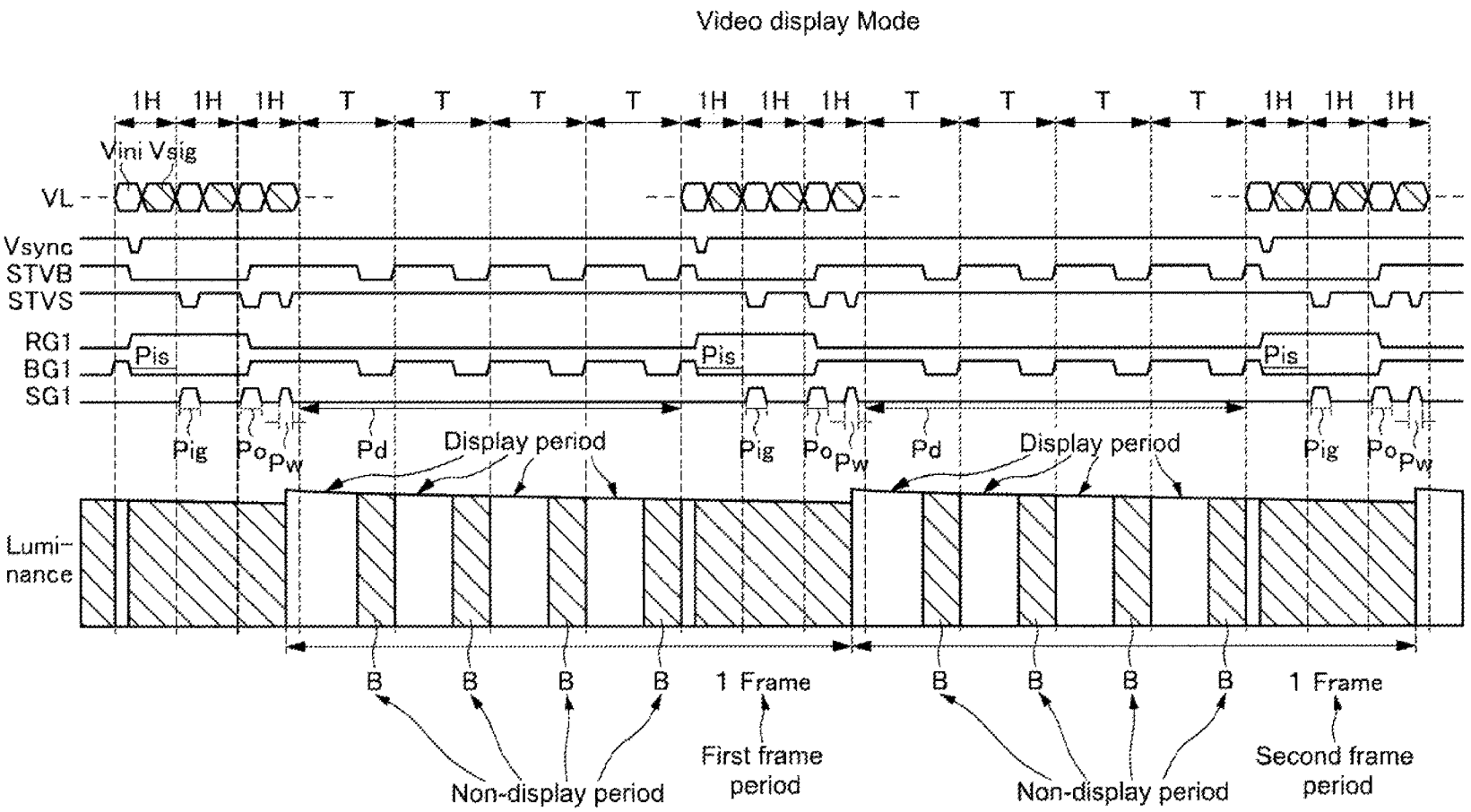
FIG. 5 is a timing chart showing a time change of each signal related to one embodiment of the present invention.

FIG. 5 is a timing chart showing a time change of each signal at the time of an operation for writing a video signal to each pixel PX for each frame period. Furthermore, among each of the plurality of control signals RG, BG and SG generated by the scanning line drive circuits YDR1, YDR2, only control signals RG1, BG1, and SG1 corresponding to a first row are shown in the same diagram. This point is the same with respect to FIG. 3 and FIG. 6 explained later.

An initialization signal Vini and video signal Vsig are supplied in sequence from the signal line drive circuit XDR to a video signal line VL at a cycle of a 1 horizontal scanning period (1H). Furthermore, although an initialization signal Vini and video signal Vsig are regularly supplied, only a part is shown in FIG. 5. In addition, a part showing an initialization signal Vini and video signal Vsig and a part not showing an initialization signal Vini and video signal Vsig have different time-scales. This point is also the same for FIG. 3 and FIG. 6 explained later.

As is shown in FIG. 5, a synchronization signal Vsync is a signal having a pulse shape activated by a constant cycle. The controller 12 is configured to activate the synchronization signal Vsync at a ratio of sixty times per second for example, based on the clock signal CKV described above. The activation cycle of the synchronization signal Vsync becomes a frame cycle. The controller 12 is configured to generate start signals STVB, STVS described above based on this synchronization signal Vsync.

Specifically explained, as is shown in FIG. 5, the controller 12 deactivates a start signal STVB with the activation of a synchronization signal Vsync, and reactivates the start signal STVB at the point where a video signal Vsig of a 3rd horizontal scanning period (1H) counting from the deactivation a start signal STVB is activated. In addition, as is shown in FIG. 5, the controller 12 temporarily deactivates the start signal STVS only while the initialization signal Vini is activated in the next horizontal scanning period (1H) after the horizontal scanning period where the synchronization signal is activated, and further temporarily deactivates the start signal STVS while the initialization signal Vini is activated and while the video signal Vsig is activated respectively in the next horizontal scanning period (1H).

The scanning line drive circuit YDR2 is configured to control the activity state of each of a plurality of control signals in sequence based on the activity state of a start signal STVB. By this control, the activity state of a control signal BG1 corresponding to a first-row changes to the same direction as the start signal STVB and at the same timing as the start signal STVB as is shown in FIG. 5. In addition, the activity state of another control signal BG similarly changes to a control signal BG while delay the control signal BG1 (see FIG. 4 described herein).

In addition, the scanning line drive circuit YDR2 is configured to activate a control signal RG according to the activation of a synchronization signal Vsync, and maintain the activity state until the point where the $3^{rd}$ horizontal scanning period (1H) counting from this activation is entered. Furthermore, a count of a horizontal scanning period (1H) may also be performed based on a clock signal supplied from the controller 12.

The scanning line drive circuit YDR1 is configured to control the activity state of each of a plurality of control signals SG respectively in sequence based on the activity state of a start signal STVS. By this control, the activity state of a control signal SG1 corresponding to a first-row changes to the reverse direction of the start signal STVS and at the same timing as the start signal STVS as is shown in FIG. 5. In addition, the activity state of another control signal SG similarly changes to a control signal BG while delay the control signal SG1

As is shown in FIG. 5, a source initialization period Pis during which a source initialization operation is performed, a gate initialization period Pig during which a gate initialization operation is performed, an offset cancel period Po during which an offset cancel operation is performed, and a video signal writing period Pw during which a video signal writing operation is performed are defined by the changes of the control signals RG1, BG1 and SG1 explained hereto. Each is explained in detailed below.

First, a source initialization period Pis is a period from deactivation of a control signal BG1 according to activation of a synchronization signal Vsync up to the final cycle of a corresponding horizontal scanning period (1H). During this period, since control signals BG1, SG1 are deactivated while a control signal RG1 is activated, the second switching element BCT and first switching element SST are both OFF (non-conducting state), and the third switching element RST is ON (conducting state). Therefore, the source electrode of a drive transistor DRT is reset to the same voltage as the reset voltage Vrst.

A gate initialization period Pig is a period when the control signal SG1 is first activated after activation of a synchronization signal Vsync. During this period, since the control signal BG1 is deactivated while the control signals RG1, SG1 are activated, the second switching element BCT is OFF (non-conducting state), and the first switching element SST and third switching element RST are both ON (conducting state). In addition, an initialization signal Vini is supplied to a video signal line VL. Therefore, an initialization signal Vini is applied to a gate electrode of a drive transistor DRT via the first switching element SST. In this way, the voltage of the gate electrode of a drive transistor DRT is reset to a voltage corresponding to an initialization signal Vini, and data of a previous frame period is initialized from a gate electrode of a drive transistor DRT.

An offset cancel period Po is a period where a control signal SG1 is activated immediately after a gate initialization period Pig. During this period, since the control signal SG1 is activated, the first switching element SST is ON (conducting state). In addition, the control signal RG1 changes from an activated state to a deactivated state within this period. Therefore, the third switching element RST changes from ON (conducting state) to OFF (non-conducting state) within this period. On the other hand, the control signal BG1 changes from a deactivated state to an activated state within this period. Therefore, the second switching element BCT changes from OFF (non-conducting state) to ON (conducting state) within this period. Furthermore, an initialization signal Vini is supplied to a video signal line VL.

Therefore, in the offset cancel period Po, the voltage of the gate electrode of the drive transistor DRT is fixed to a voltage of an initialization signal Vini. In addition, since the second switching element BCT is switched ON, current flows into the drive transistor DRT from the high voltage power supply line SLa. The voltage (reset voltage Vrst) written in the source initialization period Pis is set as an initial value, and while gradually reducing the voltage of the source electrode of the drive transistor DRT by the current which flows between the drain electrode and source electrode and shifted to a high voltage side while a variation in TRT characteristics of the drive transistor is absorbed and compensated.

The voltage of the source electrode of the drive transistor DRT becomes Vini−Vth at the point where the offset cancel period Po ends. Furthermore, Vini is a voltage value of the initialization signal Vini and Vth is a threshold voltage of the drive transistor DRT. In this way, a voltage Vgs between the gate electrode and source electrode of the drive transistor DRT reaches a cancel point (Vgs=Vth), and a potential difference corresponding to this cancel point is stored in the storage capacitor Cs. Furthermore, it is preferred that the period length of the offset cancel period Po is set to about 1 μsec for example. In addition, the offset cancel period Po may be arranged a plurality of times according to necessity.

A video signal writing period Pw is a period where a control signal SG1 is activated immediately after an offset cancel period Po. During this period, since the control signal RG1 is deactivated while the control signals SG1, BG1 are activated, the third switching element RST is OFF (non-conducting state), and the first switching element SST and second switching element BCT are both ON (conducting state). In addition, a video signal Vsig is supplied to a video signal line VL. Therefore, a video signal Vsig is written to the gate electrode of the drive transistor DRT.

In the video signal writing period Pw, current flows from a high voltage power supply line SLa, through the second switching element BCT and drive transistor DRT and further via a capacitor section (parasitic capacitor) Cel of the organic EL element EMD to a low voltage power supply electrode SLb. In this way, variation in the level of mobility of the drive transistor DRT is corrected.

Immediately after the first switching element SST is turned ON, the voltage of the gate electrode of the drive transistor DRT becomes Vsig, and the voltage of the source electrode of the drive transistor DRT becomes Vini−Vth+Cs (Vsig−Vini)/(Cs+Cel+Cad). Furthermore, Vsig is a voltage value of a video signal Vsig, Cs is a capacitance of the storage capacitor Cs, Cel is a capacitance of the capacitor section Cel, and Cad is a capacitance of the auxiliary capacitor Cad.

Following this, current flows to a low voltage power supply electrode SLb via the capacitor section Cel of an organic EL element EMD, and at the point when the video signal writing period Pw ends, the voltage of the gate electrode of the drive transistor DRT becomes Vsig, and the voltage of the source electrode of the drive transistor DRT becomes Vini−Vth+ΔV1+Cs (Vsig−Vini)/(Cs+Cel+Cad). Furthermore, the relationship between a current Idrt which flows to the drive transistor DRT and the capacitance Cs+Cel+Cad is expressed by the following formula (1). In addition, ΔV1 is an amount of change in the voltage of the source electrode corresponding to the voltage of a video signal line Vsig.

$$\int_0^{-Pw} Idrtdt = \int_{Vs}^{Vs+\Delta V1} (Cs+Cel+Cad)dV \quad (1)$$

In here, $Idrt=\beta\times(Vgs-Vth)^2=\{(Vsig-Vini)\times(Cel+Cad)/(Cs+Cel+Cad)\}^2$. In addition, β is defined as $\beta=\mu\times Cox\times W/2L$. W is a channel width of a drive transistor DRT, L is a channel length of a drive transistor DRT, μ is a level of carrier mobility, and Cox is gate electrostatic capacitance per unit area.

Display of video begins when a video signal Vsig is written to a gate electrode of a drive transistor DRT and current starts to flow to an organic EL element EMD within the video signal writing period Pw. According to the timing chart shown in FIG. 5, each pixel PX is suited to display of video by writing a video signal for each frame period, and providing a display period during which an organic EL element emits light.

However, a charge provided to the storage capacitor Cs which stores a gate voltage of a drive transistor DRT reduces over time due to leaks. That is, luminance of this display gradually drops as time passes from the video signal writing period Pw as is shown in FIG. 5. This is because a charge stored within the storage capacitor Cs continues to disappear due to leaks and the like. A charge stored within the storage capacitor Cs first decreases significantly immediately after display begins and then continues to decrease linearly.

When a period from a horizontal scanning period (1H) which comes next after a video signal writing period Pw to a horizontal scanning period (1H) during which a synchronization signal Vsync corresponding to the next frame period is activated is defined as a display period Pd, as is shown in FIG. 5, the controller 12 is configured to divide the display period Pd into a plurality of periods (four in FIG. 5), and deactivate a start signal STVB in a certain period up to the termination of each period T. In this way, a certain period from the start of each period T becomes a light emitting period (display period), a certain period up to the termination of each period T after the end of the light emitting period (display period) becomes a non-light emitting period (non-display period) B during which a control signal BG1 is deactivated and video is not displayed as is shown in FIG. 5.

Figure 6:
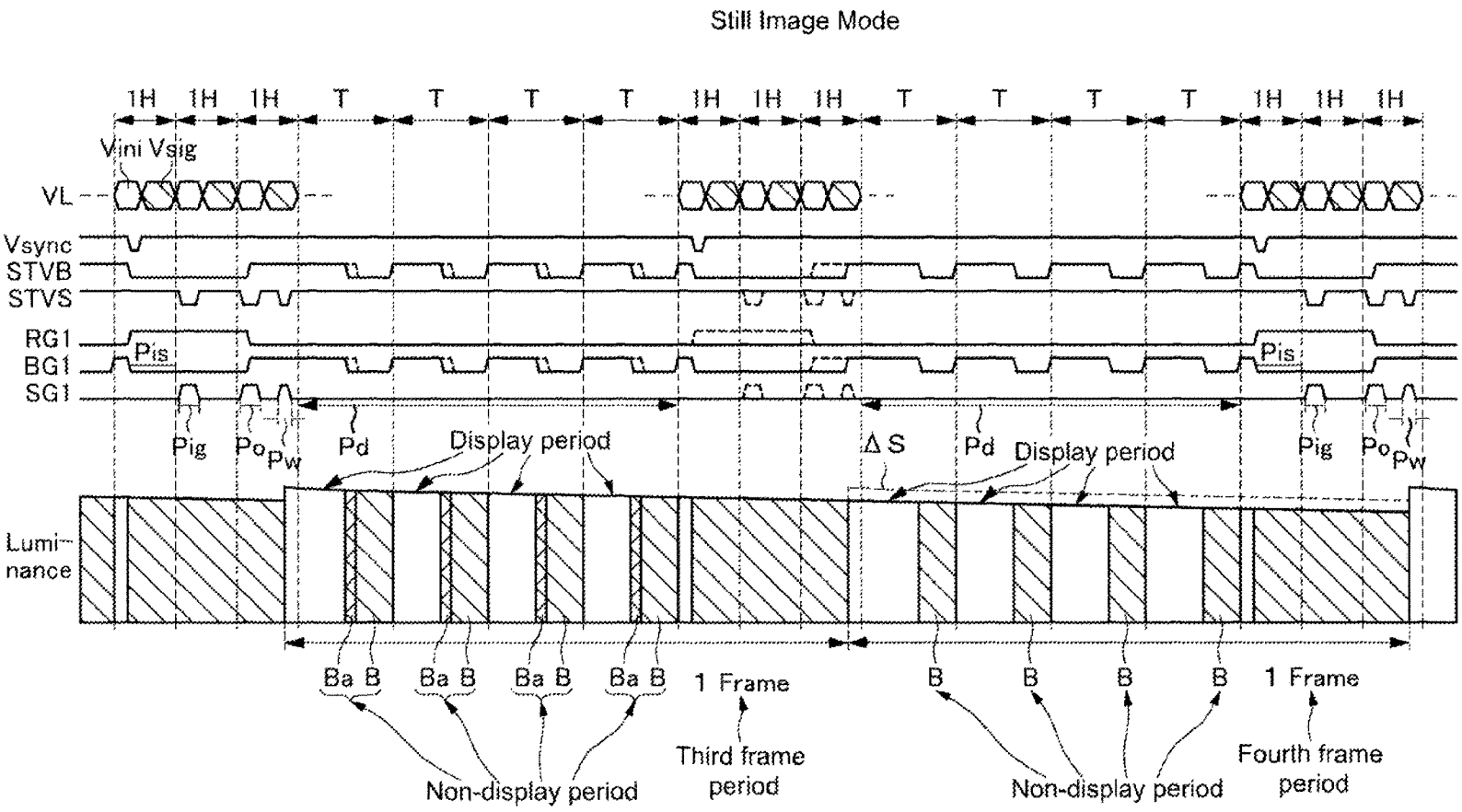
FIG. 6 is timing chart showing a time change of each signal in the case of driving a display device by lowering a frame rate with respect to the timing chart shown in FIG. 5.

FIG. 6 is a timing chart showing a time change of each signal in the case where a frame rate is dropped and display processing is performed in a display device according to the background technology which adopts the driving method described above.

In the example in FIG. 6, a change in start signals STVB, STVS is suppressed in a fourth frame period as can be understood when compared with FIG. 5. In this case, a video signal writing period Pw does not come in the fourth frame period and a video signal Vsig is not input to a pixel PX. That is, input of a video signal Vsig is thinned out at a rate of once every two times.

As a result of thinning out the input of a video signal Vsig, as is shown in FIG. 6, luminance in the fourth frame period drops by ΔS compared to the case where an input of a video signal Vsig is not thinned out. As a result, luminance at the point when the fourth frame period ends drop even further than at the point where a third frame period ends. Since a viewer experiences a value of light emitting time X luminance as brightness of a screen, the fourth frame period in which luminance has dropped is experienced more darkly compared to the third frame period.

In order to prevent this, in the example in FIG. 6, a non-light emitting period (non-display period) Ba which continues from the non-light emitting period (non-display period) B is arranged before the non-light emitting period (non-display period) B in the third frame period. As a specific process, the controller 12 divides a display period Pd into a plurality of periods, and extends a deactivated period of a start signal STVB arranged at the tail end of each period T in a forward direction. In this way, since the value of light emitting time X luminance in the third frame period becomes closer to the value of light emitting time X luminance in the fourth frame period, it is possible to reduce a difference in brightness experienced by the eye of a viewer.

However, as described above, since luminance is significantly reduced particularly at the stage immediately after the start of a display, even when configuring as in FIG. 6, a difference remains in the values of light emitting time X luminance between the third frame period and the fourth frame period. One embodiment of the present invention removes this difference and further reduces a difference in brightness (difference in the value of light emitting time X luminance) between the third frame period and the fourth frame period. This is explained in detail below while referring to FIG. 3.

Figure 3:
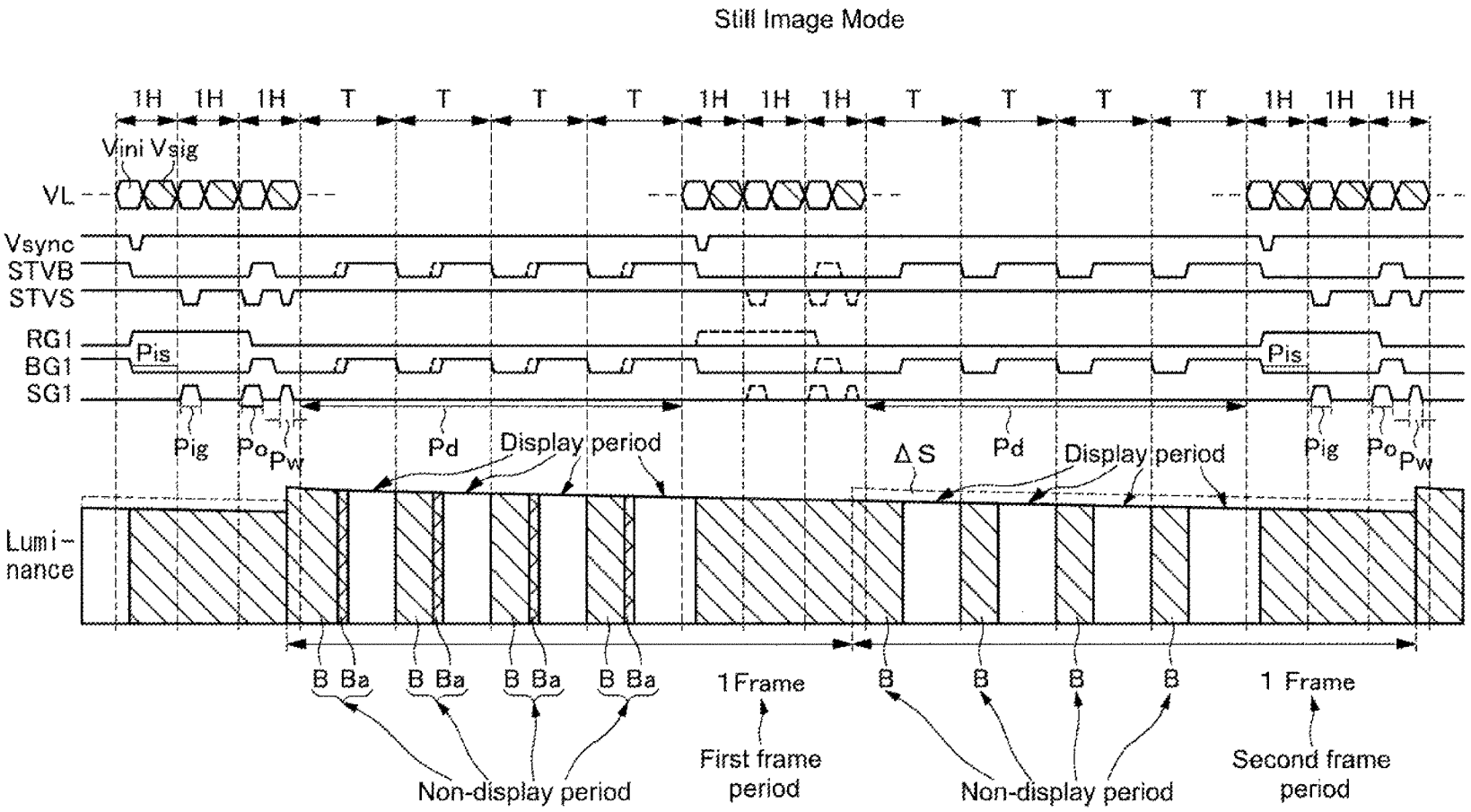
FIG. 3 is a timing chart showing a time change of each signal related to one embodiment of the present invention.

FIG. 3 is a timing chart showing a time change of each signal according to one embodiment of the present invention. As is shown in the same diagram, the driving method of the display device 100 according to the present embodiment is setting a period within a first frame period across a fixed period including the point when the first frame period starts to a non-light emitting period (non-display period) B (first non-light emitting period) by writing the video signal Vsig. In addition, dividing a display period Pd in to a plurality of periods and arranging the non-light emitting period (non-display period) not at the termination but at the beginning of each period T is different to the driving method shown in FIG. 5 and FIG. 6. Furthermore, in a first frame period in the case where an input of a video signal Vsig is thinned out, a non-light emitting period (non-display period) Ba which continues from the non-light emitting period (non-display period) B is arranged immediately after the non-light emitting period (non-display period) B arranged at the beginning of each period.

As a specific process, first the controller 12 deactivates a start signal STVB after the offset cancel period Po ends and before the video signal writing period Pw starts. In addition, the start signal STVB is maintained in a deactivated state until the beginning of the first period among a plurality of periods T. In this way, as is shown in FIG. 5, a non-light emitting period (non-display period) B is arranged at the beginning of each frame period.

Next, the controller 12 activates the start signal STVB in a constant period from the beginning of each period T obtained by dividing a display period Pd. In this way, as is shown in FIG. 5, a non-light emitting period (non-display period) B is arranged not at the termination but at the beginning of each period T.

Furthermore, in a first frame period in the case where an input of a video signal Vsig is thinned out, the controller 12 extends in a rear direction a deactivated period of a start signal STVB arranged at the start of each period obtained by dividing a display period Pd. In this way, a non-light emitting period (non-display period) Ba which continues from the non-light emitting period (non-display period) B is arranged immediately after the non-light emitting period (non-display period) B arranged at the beginning of each period T. Furthermore, the time length of each non-light emitting period (non-display period) Ba may be the same within one frame period. In addition, the timing of the start and end of a non-light emitting period (non-display period) B may be set differently on a certain row to another row in a display screen.

As explained above, according to the driving method of the display device 100 related to the present embodiment, since a period during which a charge immediately after the start of display decreases significantly is set as a non-light emitting period (non-display period) B, a value of light emitting time X luminance in each frame period is calculated by luminance which decreases linearly. Therefore, by performing control for arranging a non-light emitting period (non-display period) Ba with a certain length immediately after a non-light emitting period (non-display period) B, it is possible to align the values of light emitting time X luminance in each frame period and improve display quality by suppressing flickering.

Figure 4:
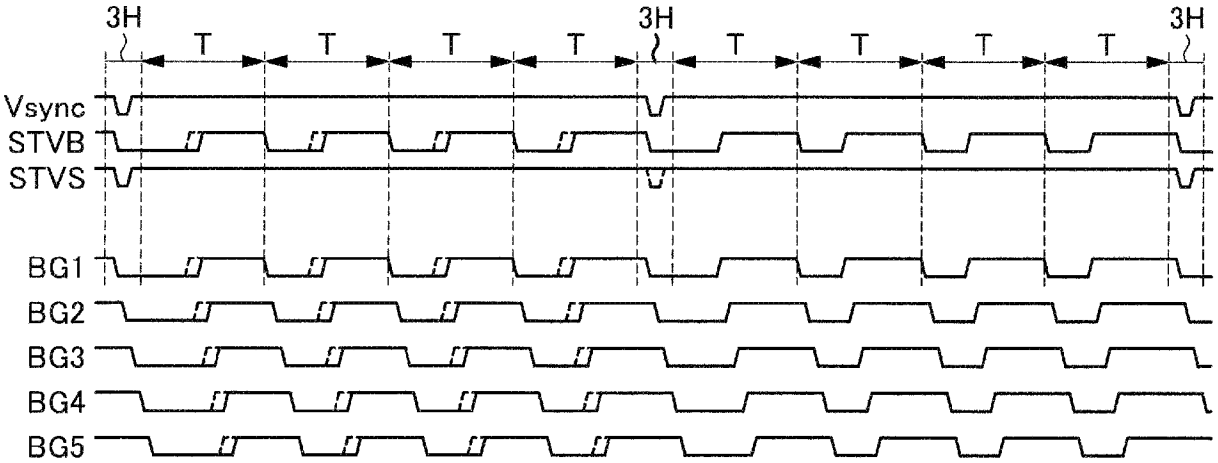
FIG. 4 is a timing chart showing a time change of each signal related to one embodiment of the present invention.

Here, a change in a control signal BG other than the control signal BG1 shown in FIG. 3 is explained while referring to FIG. 4.

FIG. 4 is a timing chart showing a time change of each signal according to an embodiment of the present invention. Four control signals BG2-BG6 corresponding to a 3rd, 5th, 7th and 9th row of a matrix of each pixel PX are shown in FIG. 4 as an example of a control signal BG other than the control signal BG1 shown in FIG. 3. Furthermore, in the same diagram, a time change of each signal of 3 horizontal scanning periods (3h) from the non-activation of a synchronization signal Vsync shown in FIG. 3 to a video signal writing period Pw is partially simplified and shown schematically.

As is shown in FIG. 4, control signals BG2~BG5 other than the control signal BG1 are configured to change by being delayed in sequence by a certain time compared to a control signal BG2 by a shift register process within the scanning line drive circuit YDR2 described above. In this way, although not shown in the diagram, the luminance of each pixel PX also changes by being delayed in sequence by a certain time compared to a pixel PX corresponding to a first row. In this way, it is possible to arrange non-light emitting periods (non-display period) B, Ba with respect to a pixel PX belonging to any row the same as a pixel PX belonging to a first row.

In this way, according to FIG. 3, a driving method is provided in which display of video is performed by a video signal written to each pixel in a certain frame period, a video signal is not written to each pixel PX in the next frame period, and the same video as a previous frame is displayed. This type of driving method is suitable in the case where still images are to be displayed in a display device. According to the driving method shown in FIG. 3, since a display device is driven by reducing a frame rate, it is possible to reduce power consumption.

Although the preferred embodiments of the present invention were explained above, the present invention is not limited to any of these embodiments, and various modes of the invention can be carried out within a scope that does not depart from the concept of the present invention.

For example, although an example was explained in the embodiments described above in which a frame rate is set to half of a normal frame rate, it is also possible to further reduce a frame rate. In this case, it is preferred that the controller 12 controls a start signal STVB so that a time length of an added non-light emitting period (non-display period) Ba is gradually shortened from a frame period immediately after writing a video signal Vsig to a frame period arranged immediately before writing the next video signal Vsig. In this way, it is possible to align a value of light emitting time X luminance between frame rates even in the case where a frame rate is set to less than half of a normal frame rate, and thereby suppress flickering and improve display quality. In addition, there is also a method for lengthening the cycle of Vsync as another method of setting a frame rate to less than half of a normal frame rate. In this case, the 3H periods in the center of FIG. 3, FIG. 4 and FIG. 6 disappear, and it is possible to remove black insertion between a first frame period and second frame period.

In addition, although an example is shown in FIG. 3 whereby control is performed so that start signals STVB and STVS are not output while a synchronization signal Vsync is input unchanged when thinning out a video signal Vsig of a second frame period, it is also possible to not generate the start signals STVB and STVS on the controller 12 side by not allowing the synchronization signal Vsync itself to be input to the controller 12 side.

Furthermore, according to one embodiment of the present invention, it is possible to perform driving suitable for video display and driving suitable for still image display by changing the timing of each signal input to a display panel DP without changing the circuit structure of the display panel DP. In other words, according to one embodiment of the present invention, a display device is provided including a video display mode which displays video corresponding to a video signal written to each pixel for each frame period, and a still image mode which displays the same image as an image based on a video signal written to each pixel in the previous frame period. In addition, it is possible to display a high-quality image with low flickering even in the case where still image display is performed.

What is claimed is:

1. A display device comprising:

a display region arranged with a plurality of pixels each including a drive transistor supplying a drive current to a display element;

a video display mode including a first frame period displaying a first video according to a first video signal, and a second frame period displaying a second video according to a second video signal; and a still image display mode including a third frame period displaying a third image according to a third video signal, and a fourth frame period displaying the third image after the third frame period, wherein the first frame period includes at least an initialization period setting a control potential of the drive transistor to a predetermined potential in each pixel, an offset cancel period obtaining a potential difference conforming to a threshold voltage of the drive transistor, a video signal writing period determining a gate-source voltage of the drive transistor according to the threshold voltage of the drive transistor and the first video signal, a display period displaying the first video according to the gate-source voltage, and the still image display mode includes a non-display period shorter than the third frame period arranged after the video signal writing period in the third frame period is completed and before displaying the third image.

2. The display device according to claim 1, wherein a timing of a start and an end of the non-display period is different between one row in a display region and another row in the display region in the still image display mode.

3. The display device according to claim 1, wherein the non-display period is inserted more than once in the third frame period in the still image display mode.

4. The display device according to claim 1, wherein the display element is an organic electroluminescence element.

* * * * *